US006125970A

United States Patent [19]

Takeuchi et al.

[11] Patent Number: 6,125,970

[45] Date of Patent: Oct. 3, 2000

[54] HYDRAULIC DEVICE FOR FORKLIFT

[75] Inventors: Toshiyuki Takeuchi; Yasuhiko Naruse; Takeharu Matsuzaki, all of Kariya; Shigeto Nakajima; Makio Tsukada, both of Nagano-ken, all of Japan

[73] Assignee: Kabushiki Kaisha Toyoda Jidoshokki Seisakusha, Aichi-ken, Japan

[21] Appl. No.: 09/094,157

[22] Filed: Jun. 9, 1998

[30] Foreign Application Priority Data

Jun. 10, 1997 [JP] Japan ..... 9-152463

[51] Int. Cl.[7] ..... B66F 9/20

[52] U.S. Cl. ..... 187/223; 187/224; 187/275; 187/285; 414/632; 414/636; 414/471; 414/629

[58] Field of Search ..... 414/636, 632, 414/629, 471; 187/223, 224, 234, 275, 285

[56] References Cited

U.S. PATENT DOCUMENTS

| | | | |
|---|---|---|---|
| 3,007,593 | 11/1961 | Hancock | 414/636 |
| 3,307,656 | 3/1967 | Susag | 187/223 |
| 3,722,723 | 3/1973 | Matthews | 414/636 |
| 3,831,492 | 8/1974 | Young | 187/223 X |
| 3,929,244 | 12/1975 | Ekstrom | 414/636 |
| 4,459,081 | 7/1984 | Reeves | 414/636 |

FOREIGN PATENT DOCUMENTS

| | | | |
|---|---|---|---|
| 000509659 | 10/1992 | European Pat. Off. | 187/223 |
| 3139635 | 4/1983 | Germany | 414/636 |
| 4-256698 | 9/1992 | Japan . | |
| WO84/03543 | 9/1984 | WIPO | 187/224 |

*Primary Examiner*—Dean J. Kramer
*Assistant Examiner*—Steven B. McAllister
*Attorney, Agent, or Firm*—Morgan & Finnegan, L.L.P.

[57] ABSTRACT

A hydraulic device for a forklift is disclosed. The forklift includes a tilting mast and a fork supported by the mast so that the fork is lifted and lowered. A tilt cylinder operates to tilt the mast by means of oil supplied by a tilt valve. A restricting valve is arranged in an oil passage connecting the tilt cylinder with the tilt valve. When the mast is tilted with the fork carrying an object and located higher than a predetermined reference position, the restricting valve closes the oil passage so that the angle of the tilting mast is limited. A check valve is arranged between the tilt cylinder and the restricting valve. The check valve blocks oil flow from the tilt cylinder to the restricting valve so that the position of the mast is maintained. This prevents unintentional movement of the mast.

19 Claims, 5 Drawing Sheets

HYDRAULIC DEVICE FOR FORKLIFT

BACKGROUND OF THE INVENTION

The present invention relates to hydraulic devices used for forklifts, and, more particularly, to hydraulic devices for controlling tilt cylinders for tilting forklift masts.

A typical forklift includes a mast and a fork. The mast is supported by a vehicle body so that the mast tilts. The fork is supported by the mast so that the fork is lifted or lowered. The forklift also includes a spool type tilt cylinder and a spool type lift cylinder. The tilt cylinder tilts the mast forward or rearward with respect to the vehicle body. The lift cylinder lifts or lowers the fork. A valve unit is provided in the forklift for controlling the oil supply to these cylinders. The valve unit includes a tilt valve corresponding to the tilt cylinder and a lift valve corresponding to the lift cylinder. A tilt lever is arranged near the operator seat. By shifting the tilt lever, the opening of the tilt valve is varied so that the tilt cylinder tilts the most forward or rearward. In the same manner, a lift lever is arranged near the operator seat. By shifting the lift lever, the opening of the lift valve is varied so that the lift cylinder lifts or lowers the fork.

In accordance with the JIS (Japanese Industrial Standards), it is prescribed that, in principle, the maximum angle of the mast with respect to the vehicle body be six degrees when the mast tilts forward and twelve degrees when the mast tilts rearward. However, for example, if the mast is tilted forward by a large angle so that an object is transferred from the fork at a relatively high position, it is difficult to transfer the object in a stable manner. Thus, when tilting the mast forward while the fork carries an object at a relatively high position, it is preferable that the maximum mast angle be smaller than six degrees.

To solve the above problem, a device has been proposed for restricting the mast angle when the mast tilts forward when the fork is located at a relatively high position. The device includes a flow control valve such as a proportional electromagnetic type flow control valve or an electromagnetic type valve. The flow control valve is arranged in an oil passage connecting the tilt cylinder with the tilt valve. If the mast angle reaches a predetermined value (smaller than six degrees) when tilting forward, when the fork is located at a relatively high position, the control valve closes the oil passage so that the mast does not tilt further forward.

The tilt cylinder includes a first chamber and a second chamber, which are separated by a piston. When oil flows into the second chamber and flows out of the first chamber via the tilt valve, a piston rod of the tilt cylinder projects to tilt the mast forward. The flow control valve is arranged in the oil passage connecting the first chamber of the tilt cylinder with the tilt valve. When the control valve closes the oil passage, oil is not permitted to flow from the first chamber. The piston rod is thus not further projected, thus preventing the mast from tilting further forward.

The flow control valve is constituted by a spool typo valve like the tilt valve. The spool type valve includes a valve housing and a spool. The spool is arranged in the housing and slides between various positions. The oil passage is selectively opened or closed depending on the position of the spool. The opening of the oil passage is varied depending on the position of the spool. The outer surface of the spool contacts the inner surface of the housing so that the spool slides. A clearance, or a gap, exists between the outer surface of the spool and the inner surface of the housing The gap must be sealed to resist oil leakage. However, if the gap is very small or sealed so tightly that the oil does not leak, the sliding resistance of the spool against the housing increases. The spool then does not slide smoothly, and the opening of the valve does not vary quickly. To avoid this problem, the gap should be large enough to ensure smooth sliding of the spool. Therefore, a certain amount of oil actually leaks from the gap.

Thus, the flow control valve and the tilt valve permit some oil leakage from the hydraulic tilt cylinder circuit. This oil leakage may cause the mast to tilt when tilting should be halted. Specifically, the weight of the fork and the object on the fork act to tilt the mast forward, or to project the piston rod. Thus, oil is urged to flow from the first chamber. If the oil passage is closed by the flow control valve and the tilt valve to maintain the position of the mast, the oil pressure in the first chamber increases. Oil leakage occurs both from the flow control valve and the tilt valve through the gaps between the spools and the housings. Such oil leakage permits the piston rod to project, which permits the mast to tilt forward. Therefore, the mast fails to maintain its position, even when the oil passage is closed by the control valve and the tilt valve.

SUMMARY OF THE INVENTION

Accordingly, it is an objective of the present invention to provide an hydraulic device for a forklift that maintains the position of the mast.

To achieve the above objective, the present invention provides a hydraulic device for a forklift having a tilting mast. The hydraulic device includes a tilt cylinder for tilting the mast and a tilt valve for controlling a fluid supply for the tilt cylinder to operate the tilt cylinder. A fluid passage is arranged between the tilt cylinder and the tilt valve. A restricting valve is arranged in the fluid passage. The restricting valve controls fluid flow in the fluid passage for regulating tilting of the mast. A check valve is arranged in the fluid passage and between the tilt cylinder and the restricting valve for blocking the fluid flow from the tilt cylinder to the restricting valve at certain times.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
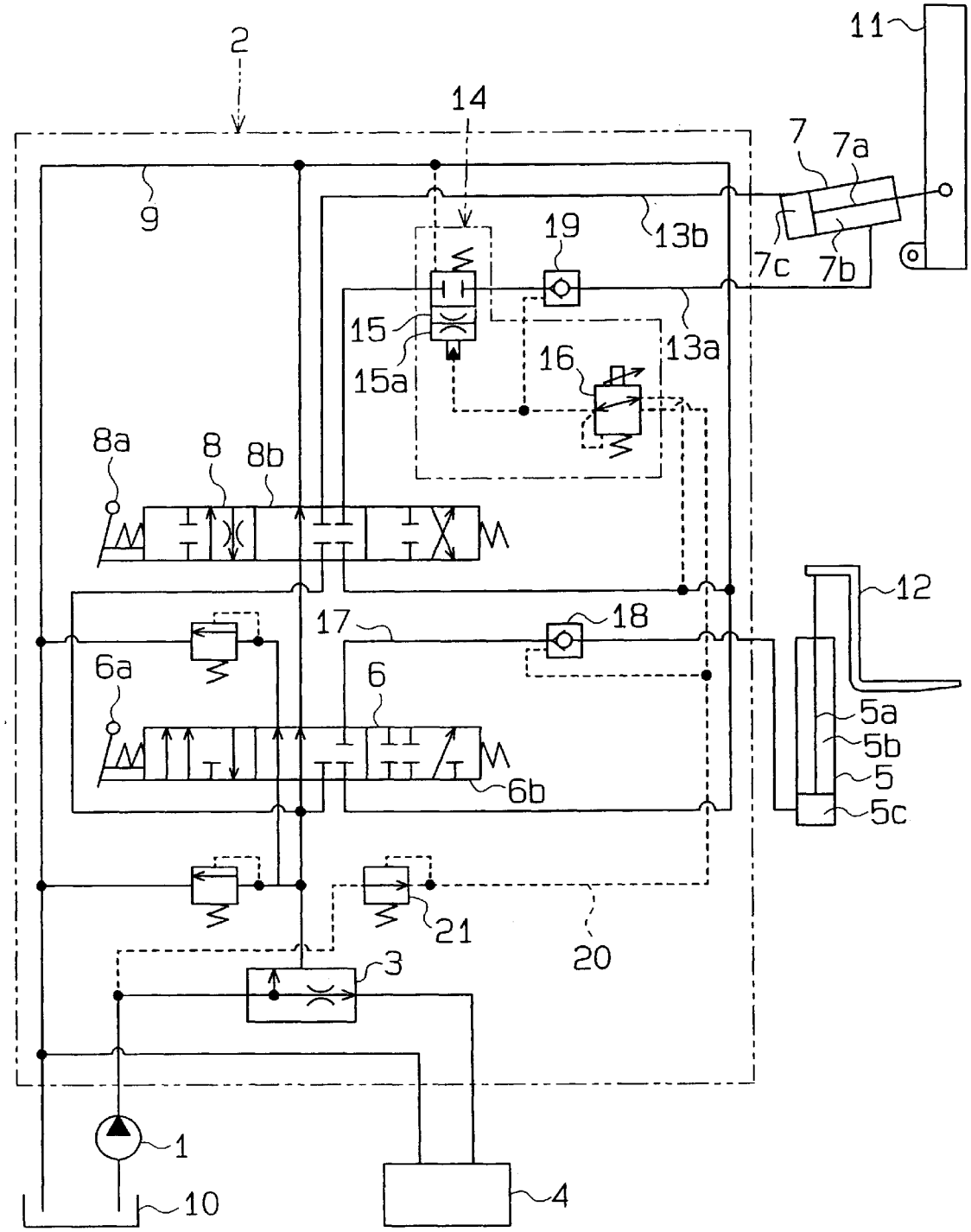
FIG. 1 is a hydraulic circuit diagram showing a hydraulic device for a forklift of a first embodiment according to the present invention.

A first embodiment according to the present invention will now be described with reference to FIGS. 1 and 2. As shown in FIG. 1, a forklift includes a mast 11 and a fork 12. The mast 11 is supported by a vehicle body (not shown) so that the mast 11 tilt&, or pivots, forward and rearward with respect to the vehicle body. The fork 12 is supported by the mast 11 so that the fork 12 is lifted or lowered. In the drawing, however, the fork 12 and the mast 11 are shown separately from each other. A tilt cylinder 7 is connected with the mast 11. The tilt, cylinder 7 includes a piston rod 7*a*. The piston rod 7*a* projects to tilt the mast 11 forward and retracts to tilt the mast 11 rearward. In this embodiment, the maximum angle of the mast 11 with respect to the vehicle body is predetermined, for example, six degrees when the mast tilts forward and twelve degrees when the mast tilts rearward. A lift cylinder 5 is connected with the fork 12. The lift cylinder 5 includes a piston rod 5*a*. Tho piston rod 5*a* projects to lift the fork 12 and retracts to lower the fork 12.

A hydraulic pump 1 sends oil from an oil reservoir 10 to a valve unit 2. The valve unit 2 controls the oil supplies for the lift cylinder 5 and the tilt cylinder 7. A distributor valve 3 is provided in the valve unit 2 for distributing the oil from the hydraulic pump 1 to the cylinders 5, 7 and a power steering device 4. The valve unit 2 also includes a lift valve 6 for operating the lift cylinder 5 and a tilt valve 8 for operating the tilt cylinder 7.

The lift valve 6 includes a valve housing (not shown) and a spool 6*b* arranged in the housing so that the spool 6*b* slides back and forth. The spool 6*b* is moved by shifting a lift lover 6*a* provided near the operator seat. The tilt valve 8 includes a valve housing (not shown) and a spool 8*b* arranged in the housing so that the spool 8*b* slides back and forth. The spool 8*b* is moved by shifting a tilt lever 8*a* provided near the operator seat. Each lever 6*a*, 8*a* rests at a neutral position when it is not shifted. The levers 6*a*, 8*a* are tilted, for example, forward or rearward with respect to their neutral positions. When the levers 6*a*, 8*a* are not shifted, the corresponding spools 6*b*, 8*b* return to their neutral positions, as shown in FIG. 1. In this state, oil is returned to the oil reservoir 10 via an outlet channel 9 after having been sent by the hydraulic pump 1 to the valves 6, 8 through the distributor valve 3.

A piston divides the interior of the tilt cylinder 7 into a first chamber 7*b* and a second chamber 7*c*. The first chamber 7*b* is connected with the tilt valve 8 by a first oil passage 13*a*, while the second chamber 7*c* is connected with the tilt valve 8 by a second oil passage 13*b*. When the tilt lever 8*a* is moved in one direction from its neutral position, the oil supplied by the hydraulic pump 1 is sent to the first chamber 7*b* via the first oil passage 13*a*. Meanwhile, the oil in the second chamber 7*c* is returned to the oil reservoir 10 through the second oil passage 13*b*, the tilt valve 8, and the outlet channel 9. The piston rod 7*a* thus retracts, which tilts the mast 11 rearward.

When the tilt lever 8*a* is moved in the opposite direction from its neutral position, the oil supplied by the hydraulic pump 1 is sent to the second chamber 7*c* via the second oil passage 13*b*. Meanwhile, the oil in the first chamber 7*b* is returned to the oil reservoir 10 through the first oil passage 13*a*, the tilt valve 8, and the outlet channel 9. The piston rod 7*a* thus projects, which tilts the mast 11 forward.

When the tilt lever 8*a* rests at its neutral position, oil is neither supplied to the chambers 7*b*, 7*c* nor drawn from the chambers 7*b*, 7*c*. The position of the mast 11 is thus maintained.

A piston divides the interior of the lift cylinder 5 into a first chamber 5*b* and a second chamber 5*c*. The second chamber 5*c* is connected with the lift valve 6 by an oil passage 17. When the lift lever 6*a* is shifted in one direction from its neutral position, the oil sent by the hydraulic pump 1 is supplied to the second chamber 5*c* via the oil passage 17. The piston rod 5*a* thus projects, which lifts the fork 12.

When the lift lever 6*a* is shifted in the opposite direction from its neutral position, the oil in the second chamber 5*c* is returned to the oil reservoir 10 via the oil passage 17, the lift valve 6, and the outlet channel 9 due to pressure caused by the weight of the fork 12 and any object that may be carried on the fork 12. The piston rod 5*a* thus retracts, which lowers the fork 12.

When the lift lever 6*a* rests at its neutral position, oil is neither supplied to the second chamber 5*c* nor drawn from the chamber 5*c*. The position of the fork 12 is thus maintained.

A restricting valve 14 is arranged in the oil passage 13*a* for restricting the angle of the mast 11 with respect to the vehicle body when the mast 11 tilts forward. The valve 14 is constituted by, for example, an electromagnetic type flow control valve, the opening of which varies as a function of the current supplied to the valve 14.

The restricting valve 14 includes a main valve 15 and a solenoid valve 16. The main valve 15 adjusts the oil flow passing through the oil passage 13*a*. The solenoid valve 16 applies pilot pressure to the main valve 15. A pilot line 20 introduces oil from the hydraulic pump 1 directly to the solenoid valve 16. The solenoid valve 16 produces electromagnetic force in relation to current supplied to a coil (not shown) of the valve 16. The solenoid valve 16 then applies pilot pressure to the main valve 15 as a function of the electromagnetic force by means of the oil sent through the pilot line 20.

The main valve 15 includes a valve housing (not shown) and a spool 15*a*. The spool 15*a* is arranged in the housing so that the spool 15*a* slides. A spring urges the spool 15*a* in one direction. The pilot pressure and the spring force press the spool 15*a* in opposite directions. The position of the spool 15*a* is determined by the balance, or equilibrium, between the spring urging force and the pilot pressure. The position of the spool 15*a* is varied in relation to the pilot pressure. The opening of the valve is varied depending on the position of the spool 15*a*. In other words, the oil flow passing through the main valve 15 is varied as a function of the current supplied to the solenoid valve 16. When no current is supplied to the solenoid valve 16, no pilot pressure is applied to the main valve 15, and the main valve 15 closes the oil passage 13*a*.

A check valve 19 is provided in the oil passage 13*a* and between the main valve 15 and the tilt cylinder 7. The check valve 19 includes a valve seat and a valve body. The valve body is opposed to the valve seat and approaches or separates from the valve seat. The solenoid valve 16 applies pilot pressure not only to the main valve 15 but also to the check valve 19. With the pilot pressure applied to the check valve 19, the valve 19 is maintained in an open state. In this state, oil flow from the main valve 15 to the tilt cylinder 7 and oil flow from the tilt cylinder 7 to the main valve 15 are both permitted. However, when no pilot pressure is applied to the check valve 19, the check valve 19 blocks the oil flow from the tilt cylinder 7 to the main valve IS.

A check valve 18 is also provided in the oil passage 17 and between the lift valve 6 and the lift cylinder 5. The check valve 18 includes a valve body and a valve seat. The valve body is opposed to the valve body and approaches or separates from the valve seat. The pilot line 20 applies pilot pressure directly to the check valve 18. Thus, when the hydraulic pump 1 is activated, or when the engine of the forklift is driven, pilot pressure is applied to the check valve 18, thus maintaining the valve 18 in an open state. In this state, oil flow from the lift valve 6 to the lift cylinder 5 and oil flow from the lift cylinder 5 to the lift valve 6 are both permitted. When no pilot pressure is applied to the check valve 18, the valve 18 blocks the oil flow from the lift cylinder 5 to the lift valve 6.

A pressure regulator valve 21 is arranged in the pilot line 20. The valve 21 maintains the pressure of the oil delivered by the hydraulic pump 1 at a constant level. The oil is then sent to the solenoid valve 16 and the check valve 18. Thus, even though the pressure at the outlet of the hydraulic pump 1 varies, a constant pilot pressure is applied to the valves 16, 18.

Figure 2:
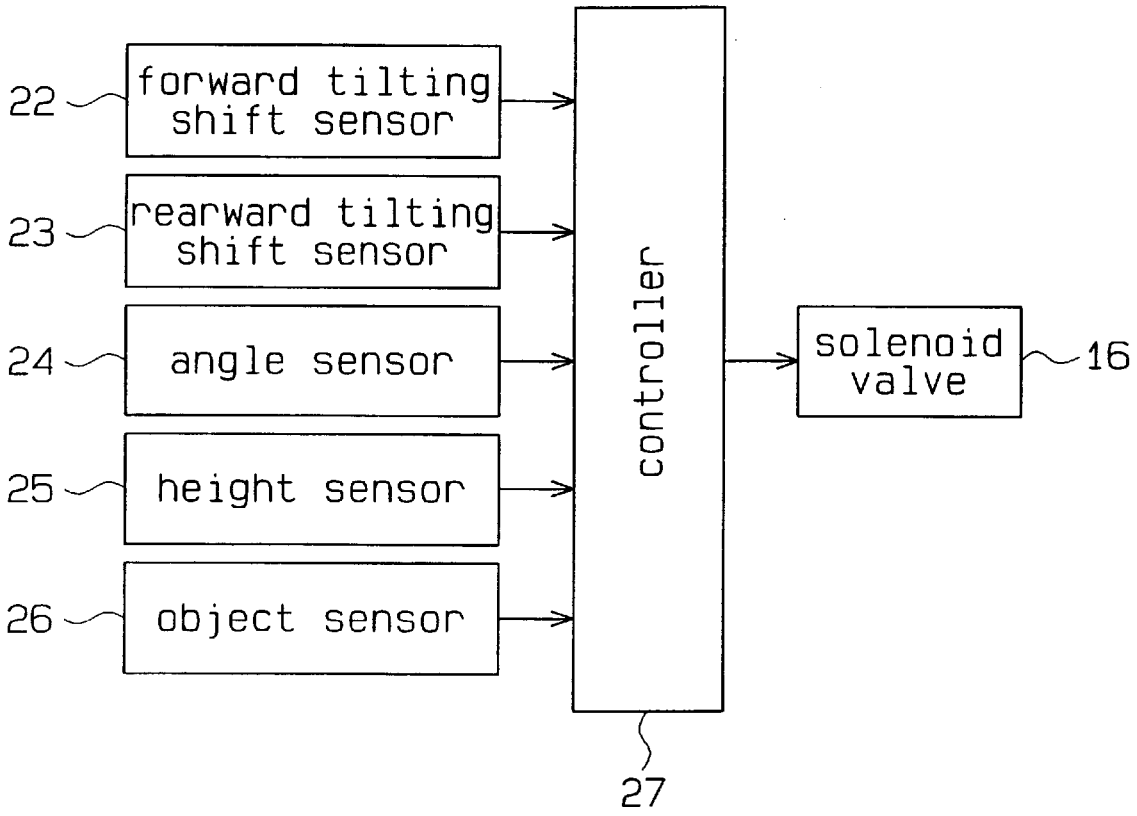
FIG. 2 is a block diagram showing a control of the hydraulic device of FIG. 1.

As shown in FIG. 2, a forward tilting shift sensor 22 senses that the tilt lever 8*a* is being shifted in a direction to tilt the mast 11 forward. A rearward tilting shift sensor 23 senses that the tilt lever 8*a* is being shifted to tilt the mast 11 rearward. Each sensor 22, 23 is constituted by, for example, a micro switch and outputs a detection signal to a controller 27.

When the tilt lever 8*a* is being shifted in accordance with the detection signal from the sensor 22 or the sensor 23, the controller 27 supplies a predetermined value of current to the solenoid valve 16 of the restricting valve 14. A predetermined pilot pressure is then applied to the main valve 15 and the check valve 19. The valves 15, 19 thus open the oil passage 13*a*. In this state, oil is permitted to flow between the tilt valve 8 and the tilt cylinder 7. The mast 11 thus tilts forward or rearward in accordance with the position of the tilt lever 8*a*. When the tilt lever 8*a* is not shifted, the controller 27 applies no current to the solenoid valve 16. Thus, no pilot pressure is applied to the main valve 15 and the check valve 19. In this state, each valve 15, 19 closes the oil passage 13*a*.

An angle sensor 24, which is constituted by, for example, a rotary type potentiometer, is arranged on the mast 11. The angle sensor 24 detects the tilt angle of the mast 11. A height sensor 25 is arranged on the mast 11 for detecting the height of the fork 12. The height sensor 25 may be, for example, an encoder or a potentiometer that continuously detects the height of the fork 12 and outputs a signal corresponding to the detected height. Alternatively, the height sensor 25 may be a proximity switch or a limit switch that senses that the fork 12 is located higher than a predetermined position and outputs an ON/OFF signal. An object sensor 26 is arranged in the lift cylinder 5 for sensing an object carried on the fork 12. The object sensor 26 includes, for example, a pressure sensor that detects the hydraulic pressure in the second chamber 5*c* of the lift cylinder 5 to judge the weight of an object on the fork 12. These sensors 24, 25, 26 output detection signals to the controller 27.

When the mast 11 tilts forward, the controller 27 determines whether the mast angle needs be restricted to a smaller value than the predetermined maximum value, or six degrees, in accordance with the detection signals from the sensors 25, 26. Specifically, when the forward tilt angle of the mast 11 reaches a predetermined value (for example, two or three degrees) when the fork 12 is carrying an object that is lifted higher than the predetermined position, the controller 27 discontinues the current supply to the solenoid valve 16. The main valve 15 and the check valve 19 then close the oil passage 13*a*. The oil in the first chamber 7*b* of the tilt cylinder 7 is thus not permitted to flow out, thus preventing the piston rod 7*a* of the tilt cylinder 7 from further projecting. Thus, the mast 11 cannot tilt further forward. In this manner, by restricting the angle of the mast 11 tilting forward, the object is transferred in a stable manner from the fork 12, when located at a relatively high position. However, if the fork 12 is located at the predetermined position or lower, the controller 27 does not restrict the forward tilt angle of the mast 11. Thus, the mast 11 is allowed to tilt forward to the predetermined maximum angle, or six degrees.

The above described control, which restricts the angle of the mast 11, is particularly effective when the mast 11 tilts forward. However, this control may be performed also when the mast 11 tilts rearward.

The main valve 15 of the restricting valve 14 and the tilt valve 8 are both spool type valves. As described above, the housing of each valve 15, 8 has an inner surface that contacts an outer surface of the associated spool 15*a*, 8*a* so that the spool 15*a*, 8*a* slides back and forth. A gap between the inner surface of the housing of each valve 15, 8 and the outer surface of the associated spool 15*a*, 8*a* is large enough to ensure smooth sliding of the spool 15*a*, 8*a*. A certain amount of oil then leaks from the gap. However, in this embodiment, the check valve 19 arranged in the oil passage 13*a* and between the main valve 15 and the tilt cylinder 7 positively prevents the mast 11 from tilting forward as a result of the leakage.

Specifically, when the tilt lever 8*a* is not shifted, the tilt valve 8 prevents oil from being supplied to the tilt cylinder 7 and from being drawn from the tilt cylinder 7. Also, the main valve 15 and the check valve 19 close the oil passage 13*a*. Since the weight of the fork 12 and any object that may be on the fork 12 acts to project the piston rod 7*a* of the tilt cylinder 7, the oil in the first chamber 7*b* of the tilt cylinder 7 is urged to flow from the first chamber 7*b*. However, the pressure of the oil in the first chamber 7*b* presses the valve body of the check valve 19 firmly against the valve teat. The check valve 19 thus is forcefully sealed and positively blocks the oil flow from the first chamber 7*b* to the main valve 15. The oil is thus retained in the first chamber 7*b*, thus positively maintaining the position of the mast 11. The mast 11 thus cannot tilt forward As described above, when the tilt lever 8*a* is not shifted when the fork 12 carries an object, the check valve 19 positively prevents the mast 11 from tilting forward. The check valve 19 prevents tilting of the mast 11 when the tilt lever 8*a* is not shifted, regardless of whether the forklift engine or the hydraulic pump 1 is activated. Furthermore, the check valve 19 and the restricting valve 14 are closed when the hydraulic pump 1 is deactivated. Thus, even when the tilt lever 8*a* is shifted with the forklift engine stopped, the mast 11 cannot tilt.

The check valve 18 located between the lift cylinder 5 and the lift valve 6 is always maintained in an open state when the hydraulic pump 1 is activated. The lift cylinder 5 then responds quickly to the shifting of the lift lever 6*a*, thus lifting or lowering the fork 12 smoothly. When the forklift engine is stopped, or when the hydraulic pump 1 is deactivated, the check valve 18 is closed. Thus, even though the weight of the fork 12 and any object that may be carried on the fork 12 urges the oil in the second chamber 5*c* of the lift cylinder 5 to flow from the second chamber 5*c*, the check valve 18 positively blocks the oil flow from the second chamber 5*c* to the lift valve 6. In this manner, oil leakage does not occur in the spool type lift valve 6, thus preventing the fork 12 from being lowered Furthermore, even if the lift lever 6*a* is shifted when the forklift engine is stopped, or with the hydraulic pump 1 deactivated, the fork 12 will not lower.

One solenoid valve 16 applies pilot pressure to the main valve 15 of the restricting valve 14 and the check valve 19. Operation of the main valve 15 thus synchronizes with operation of the check valve 19. The tilt cylinder 7 then responds quickly to the shifting of the tilt lever 8*a*. Furthermore, the structure of this hydraulic device is each check valve 19, 18 receives pilot pressure via an oil passage downstream of the associated valve 8, 6, a time lag would occur between the shifting of each lever 8*a*, 6*a* and the operation of the associated check valve 19, 18. The tilt cylinder 7 and the lift cylinder 5 thus do not respond quickly to the shifting of the associated levers 8*a*, 6*a* However, in the embodiment of FIG. 1, the pilot line 20 applies hydraulic pressure from the hydraulic pump 1, or pilot pressure, to the check valves 18, 19 directly or via the solenoid valve 16. The tilt cylinder 7 and the lift cylinder 5 thus respond quickly to the shifting of the associated levers 8*a*, 6*a*.

Figure 3:
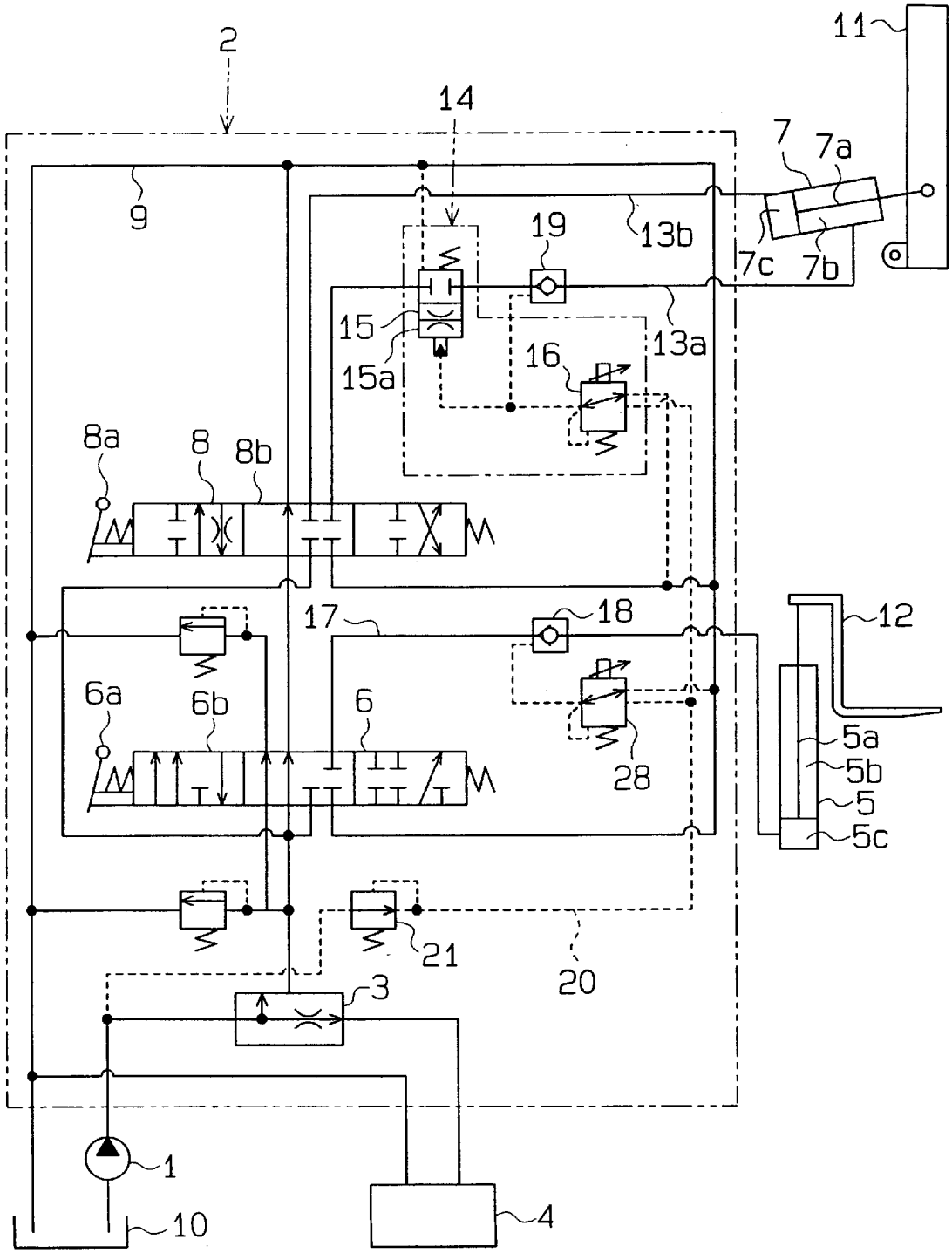
FIG. 3 is a hydraulic circuit diagram showing a hydraulic device of a second embodiment according to the present invention.
Figure 4:
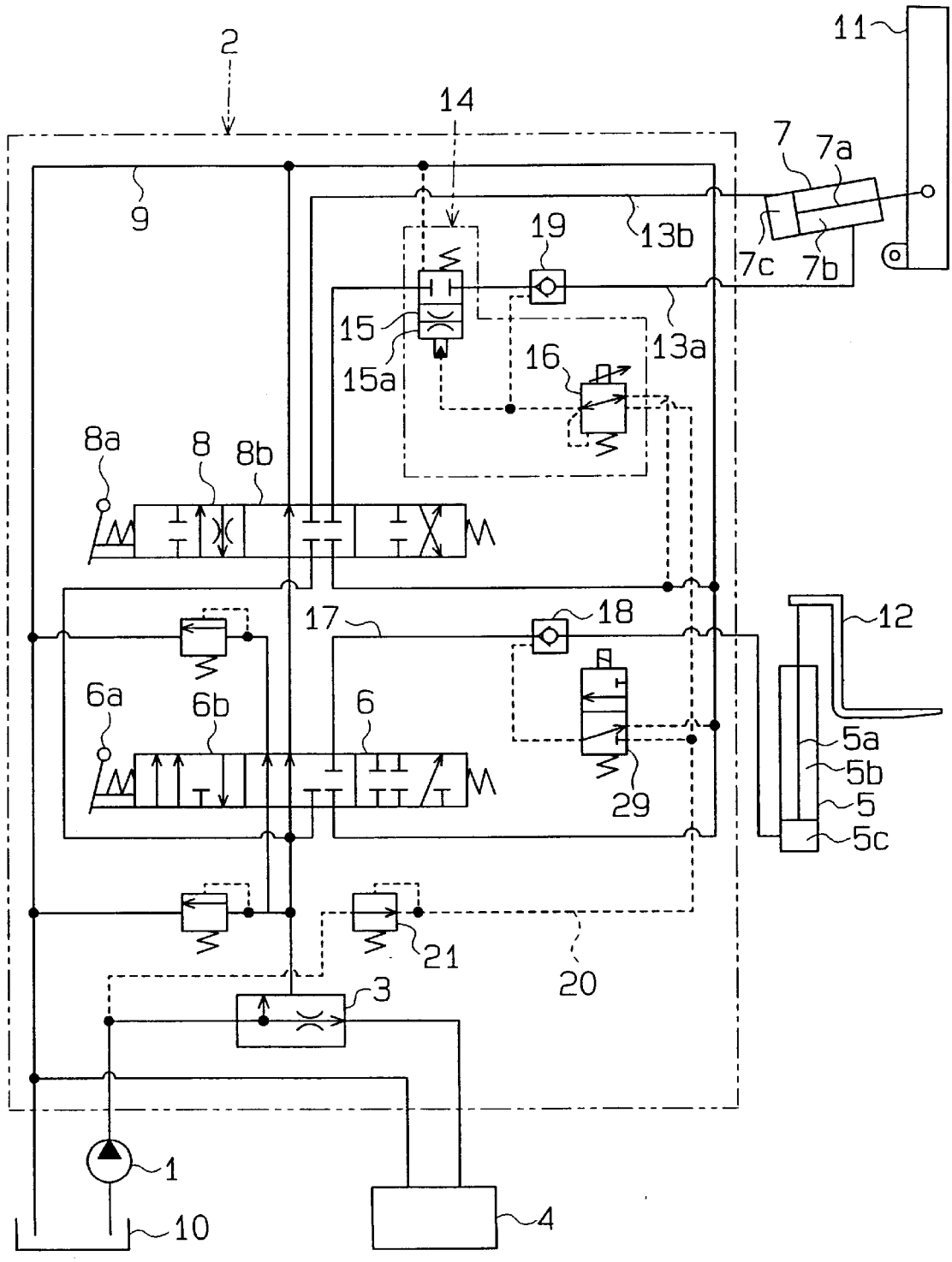
FIG. 4 is a hydraulic circuit diagram showing a hydraulic device of a third embodiment according to the present invention.
Figure 5:
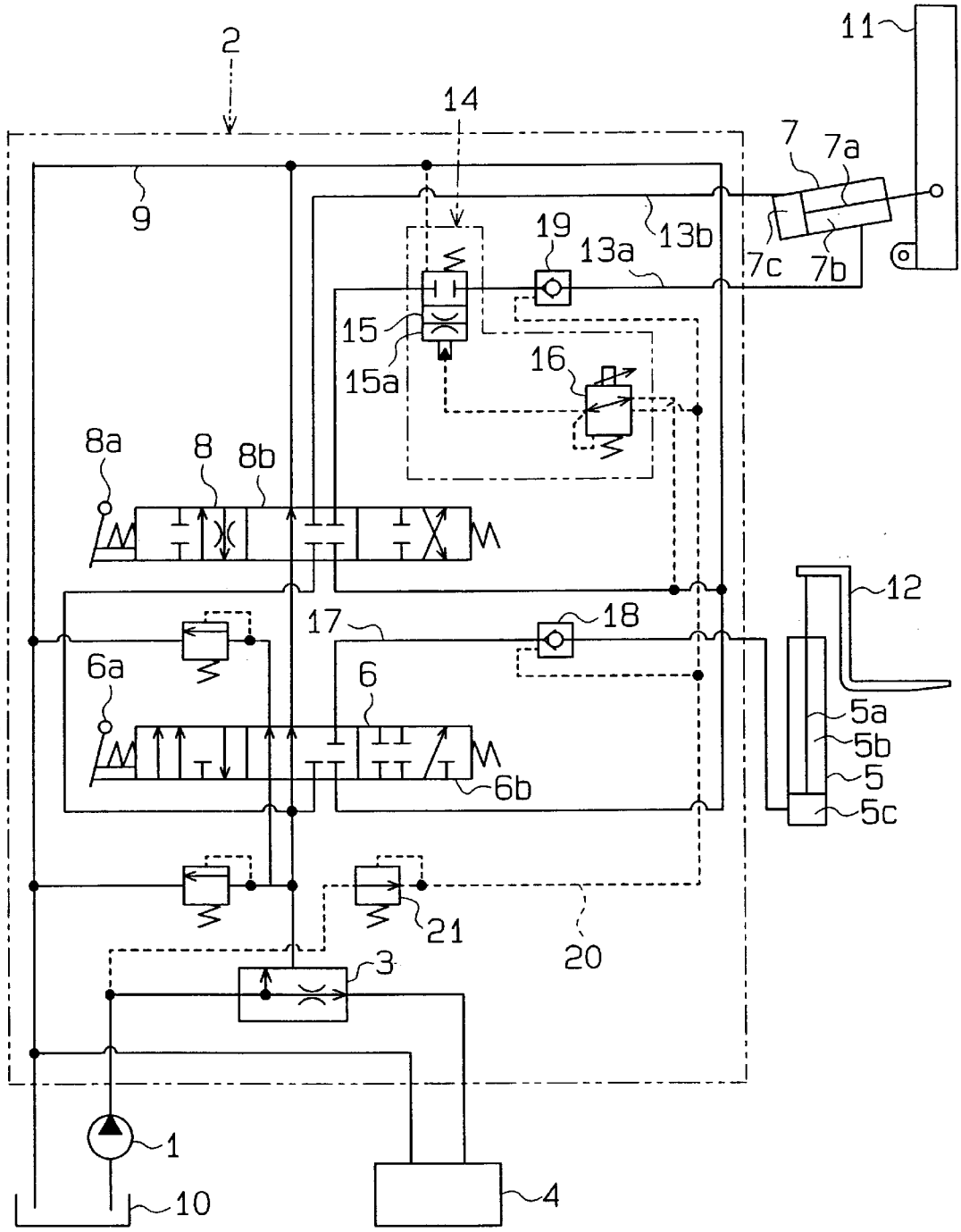
FIG. 5 is a hydraulic circuit diagram showing a hydraulic device of a fourth embodiment according to the present invention.

Second to fourth embodiments according to the present invention will hereafter be described with reference to FIGS. 3 to 5. To avoid a redundant description, like or same reference numerals are given to those components that are like or the same as the corresponding components of the first embodiment. A second embodiment will first be described with reference to FIG. 3. In the second embodiment, a solenoid valve 28 applies pilot pressure to the check valve 18 corresponding to the lift cylinder 5. The solenoid valve 28 is identical to the solenoid valve 16 of the first embodiment. That is, the oil sent by the hydraulic pump 1 flows to the solenoid valve 28 via the pilot line 20. The solenoid valve 28 then applies pilot pressure to the check valve 18 as a function of the current applied to the valve 28 by the oil sent via the pilot line 20. The controller 27 shown in FIG. 2 controls the solenoid valve 28.

A sensor (not shown) detects the position of the lift lever 6*a*, or the angle of the lift lever 6*a* with respect to its neutral position. The controller 27 delivers current to the solenoid valve 28 as a function of the position of the lift lever 6*a* in accordance with a detection signal from the sensor. The solenoid valve 28 then applies pilot pressure to the check valve 18 as a function of the position of the lift lever 6*a*. When the lift lever 6*a* is not shifted, the controller 27 applies no current to the solenoid valve 28. The check valve 18 then closes the oil passage 17.

As described above, when the lift lever 6*a* is not shifted, the check valve 18 positively blocks the oil flow from the second chamber 5*c* of the lift cylinder 5 to the lift valve 6, regardless of activation of the hydraulic pump 1. The fork 12 thus cannot move downward.

If the fork 12 reaches a predetermined position while the fork 12 is being lowered in accordance with the shifting of the lift lever 6*a*, the current supply to the solenoid valve 28 may be discontinued so that the check valve 18 closes. In this case, the controller 27 controls the solenoid valve 28 in accordance with the height of the fork 12 detected by a height sensor 25 shown in FIG. 2. In this manner, the fork 12 may be automatically stopped at a desired position during its downward movement.

A third embodiment according to the present invention will now be described with reference to rig. 4. In this embodiment, an electromagnetic type two-position switch valve 29 is employed to apply pilot pressure to the check valve 18 corresponding to the lift cylinder 5. The switch valve 29 selectively opens or closes the pilot line 20 with respect to the check valve 18 in accordance with a signal from the controller 27 shown in FIG. 2. The controller 27 controls the switch valve 29 such that pilot pressure is applied to the check valve 18 only when the lift lever 8*a* is shifted so that the fork 12 is lowered. Since the oil flow from the lift valve 6 to the lift cylinder 5 opens the check valve 18 when the fork 12 is lifted, the pilot pressure need not be applied to the check valve 18 during lifting. The operation and effects of the third embodiment are essentially the same as those of the second embodiment shown in FIG. 3.

A fourth embodiment according to the present invention will now be described with reference to FIG. 5. Unlike the first embodiment shown in FIG. 1, the solenoid valve 16 of the fourth embodiment applies pilot pressure only to the main valve 15. The check valve 19 corresponding to the tilt cylinder 7 receives pilot pressure directly from the pilot line 20, like the check valve 18 corresponding to the lift cylinder 5. The check valves 18, 19 are thus both closed when the hydraulic pump 1 is deactivated. Thus, even though the levers 6*a*, 8*a* are shifted, when the hydraulic pump 1 is deactivated neither forward tilting of the mast 11 nor lowering of the fork 12 is permitted. However, when the hydraulic pump 1 is activated, each check valve 18, 19 is maintained in an open state. The cylinders 7, 5 thus respond quickly to the shifting of the associated levers 8*a*, 6*a*.

The present invention is not restricted to the above described embodiments and may be modified as follows.

In the first to fourth embodiments, the restricting valve 14 corresponding to the tilt cylinder 7 may be an electromagnetic type two-position switch valve. Such switch valve selectively opens or closes the oil passage 13*a* in accordance with instructions from the controller 27.

In the first to fourth embodiments, the restricting valve 14 is arranged in the oil passage 13*a* corresponding to the first chamber 7*b* of the tilt cylinder 7. Instead, the valve 14 may be arranged in the oil passage 13*b* corresponding to the second chamber 7*c* of the tilt cylinder 7.

In the first to third embodiments, the valve applying pilot pressure to the check valve 19 corresponding to the tilt cylinder 7 is not restricted to a solenoid-type valve. Other types of valves may be employed for this purpose.

In the first embodiment shown in FIG. 1, the forward tilt angle of the mast 11 is restricted when the fork 12 carries an object higher than a predetermined position. However, the angle of the mast 11 need not be restricted when the object on the fork 12 is relatively light. The restriction of the mast angle may be performed only when the object on the fork 12 is located at a relatively high position and is heavier than a predetermined weight. Furthermore, the mast angle restriction may be performed regardless of the height of the fork 12, as long as the fork 12 carries an object or as long as the weight of the object exceeds a predetermined value.

Instead of restricting the angle of the mast 11 or in addition to such restriction, the restricting valve 14 may restrict the tilt speed of the mast 11 depending on the weight of the object on the fork 12 and/or the height of the fork 12. The tilt speed of the mast 11 is determined by the oil flow rate passing through the oil passages 13*a*, 13*b*. Thus, the restriction valve 14 may restrict the tilt speed of the mast 11 by restricting the oil flow rate passing through the oil passage 13*a*. The tilt speed restriction may be performed during both forward tilting and rearward tilting of the mast 11. Alternatively, mast angle restriction may be performed during only forward tilting or only rearward tilting of the mast 11. As described above, the present invention is applicable in a device having a valve that restricts tilting (the angle and/or the tilt speed) of the mast 11 if necessary by restricting fluid flow passing through the oil passages 13*a*, 13*b* connecting the tilt cylinder 7 with the tilt valve 8.

Therefore, the present examples and embodiments are to be considered as illustrative and not restrictive and the invention is not to be limited to the details given herein, but may be modified within the scope and equivalence of the appended claims.

What is claimed is:

1. A hydraulic device for a forklift having a tilting mast, comprising:

a tilt cylinder for tilting the mast;

a tilt valve for controlling a fluid supply for the tilt cylinder to operate the tilt cylinder;

a fluid passage arranged between the tilt cylinder and the tilt valve;

a restricting valve arranged in the fluid passage, wherein the restricting valve controls fluid flow in the fluid passage for regulating tilting of the mast;

a check valve arranged in the fluid passage and between the tilt cylinder and the restricting valve for blocking the fluid flow from the tilt cylinder to the restricting valve at certain times;

a pump for supplying a fluid to the tilt cylinder;

a pilot line for connecting the pump with the check valve, wherein the check valve is maintained in an open state by fluid pressure introduced to the check valve from the pump via the pilot line;

an operating member for operating the tilt valve; and a pilot valve arranged in the pilot line, wherein when the tilt valve is operated by the operating member so that the mast is tilted, the pilot valve opens the pilot line so that the check valve opens.

2. The hydraulic device as set forth in claim 1, wherein the tilt valve and the restricting valve are spool type valves.

3. The hydraulic device as set forth in claim 1, further comprising a, tilt angle sensor, wherein a maximum tilt angle of the mast is predetermined, and wherein, when the mast is tilted, the restricting valve closes the fluid passage in response to a signal from the tilt angle sensor so that the tilt angle of the mast is restricted to a smaller value than the predetermined tilt angle at certain times.

4. The hydraulic device as set forth in claim 3, further comprising a fork height sensor wherein the forklift includes a load carrying fork supported by the mast so that the fork may be lifted and lowered, and wherein the restricting valve restricts the angle of the mast in response to a signal from the fork height sensor if the fork is located higher than a predetermined reference position while carrying the load.

5. The hydraulic device as set forth in claim 1, wherein the forklift includes a load carrying fork supported by the mast so that the fork may be lifted and lowered, further comprising a fork height sensor and a load sensor, and wherein the restricting valve regulates tilting of the mast in response to a signal from the fork height sensor or load sensor according to the height of the fork or according to the load on the fork.

6. The hydraulic device as set forth in claim 1, wherein the restricting valve includes a main valve arranged in the fluid passage and the pilot valve, and wherein the pilot valve applies fluid pressure from the pilot line to the main valve so that the main valve opens.

7. The hydraulic device as set forth in claim 1, wherein the forklift includes a load carrying fork supported by the mast so that the fork may be lifted and lowered, wherein the fluid passage is a first fluid passage, and wherein the check valve is a first check valve, the hydraulic device further comprising:

a lift cylinder for lifting and lowering the fork;

a lift valve for controlling a fluid supply for the lift cylinder to operate the lift cylinder;

a second fluid passage arranged between the lift cylinder and the lift valve; and a second check valve arranged in the second fluid passage for blocking fluid flow from the lift cylinder to the lift valve at certain times.

8. The hydraulic device as set forth in claim 7, wherein the lift valve is a spool type valve.

9. The hydraulic device as set forth in claim 7, further comprising:

the pump for supplying a fluid to the lift cylinder; and a pilot line for connecting the pump with the second check valve, wherein the second check valve is maintained in an open state by fluid pressure introduced to the second check valve from the pump via the pilot line.

10. The hydraulic device as set forth in claim 9, further comprising:

an operating member for operating the lift valve; and a pilot valve arranged in the pilot line, wherein, when the lift valve is operated by the operating member so that the fork is lifted or lowered, the pilot valve opens the pilot line so that the second check valve opens.

11. A hydraulic device for a forklift having a tilting mast and a load carrying fork supported by the mast so that the fork is lifted and lowered, the hydraulic device comprising:

a tilt cylinder for tilting the mast;

a fluid pump;

a spool type tilt valve for controlling a fluid supply from the pump to the tilt cylinder to operate the tilt cylinder;

a fluid passage arranged between the tilt cylinder and the tilt valve;

a spool type restricting valve arranged in the fluid passage, wherein the restricting valve controls fluid flow in the fluid passage for regulating tilting of the mast according to the height of the fork or according to the load on the fork;

a check valve arranged in the fluid passage and between the tilt cylinder and the restricting valve for blocking fluid flow from the tilt cylinder to the restricting valve at certain times; and a pilot line for connecting the pump with the check valve, wherein the check valve is maintained in an open state by fluid pressure introduced to the check valve from the pump via the pilot line.

12. The hydraulic device as set forth in claim 11, farther comprising a tilt angle sensor, wherein a maximum tilt angle of the mast is predetermined, and wherein, when the mast is tilted with the fork carrying an object while located higher than a predetermined reference position, the restricting valve closes the fluid passage in response to a signal from the tilt angle sensor so that the maximum angle of the tilting mast is restricted to a smaller value than the predetermined angle.

13. The hydraulic device as set forth in claim 11, further comprising:

an operating member for operating the tilt valve; and a pilot valve arranged in the pilot line, wherein, when the tilt valve is operated by the operating member so that the mast is tilted, the pilot valve opens the pilot line so that the check valve opens.

14. The hydraulic device as set forth in claim 13, wherein the restricting valve includes a main valve arranged in the fluid passage and the pilot valve, and wherein the pilot valve applies fluid pressure from the pilot line to the main valve so that the main valve opens.

15. The hydraulic device as set forth in claim 11, wherein the fluid passage is a first fluid passage, and wherein the check valve is a first check valve, the hydraulic device further comprising:

a lift cylinder for lifting and lowering the fork;

a spool type lift valve for controlling a fluid supply from the pump to the lift cylinder to operate the lift cylinder;

a second fluid passage arranged between the lift cylinder and the lift valve; and a second check valve arranged in the second fluid passage for blocking fluid flow from the lift cylinder to the lift valve at certain times, wherein the second check valve is connected with the pump by the pilot line, and wherein the second check valve is maintained in an open state by fluid pressure introduced to the check valve from the pump via the pilot line.

16. The hydraulic device as set forth in claim 15, further comprising:

an operating member for operating the lift valve; and a pilot valve arranged in the pilot line, wherein, when the lift valve is operated by the operating member so that the fork is lifted or lowered, the pilot valve opens the pilot line so that the second check valve opens.

17. A hydraulic device for a forklift having a tilting mast, comprising:

a tilt cylinder for tilting the mast;

a tilt valve for controlling a fluid supply for the tilt cylinder to operate the tilt cylinder;

a tilt angle sensor for sensing the tilt angle of the tilt cylinder;

a fluid passage arranged between the tilt cylinder and the tilt valve;

a restricting valve arranged in the fluid passage, wherein the restricting valve controls fluid flow in the fluid passage for regulating tilting of the mast; and a check valve arranged in the fluid passage and between the tilt cylinder and the restricting valve for blocking the fluid flow from the tilt cylinder to the restricting valve at certain times;

wherein a maximum tilt angle of the mast is predetermined, and wherein, when the mast is tilted, the restricting valve closes the fluid passage in response to a signal from the tilt angle sensor so that the tilt angle of the mast is restricted to a smaller value than the predetermined tilt angle at certain times.

18. The hydraulic device as set forth in claim 17, further comprising a fork height sensor, wherein the forklift includes a load carrying fork supported by the mast so that the fork may be lifted and lowered, and wherein the restricting valve restricts the angle of the mast in response to a signal from the fork height sensor if the fork is located higher than a predetermined reference position while carrying the load.

19. A hydraulic device for a forklift having a tilting mast, comprising:

a tilt cylinder for tilting the mast;

a tilt valve for controlling a fluid supply for the tilt cylinder to operate the tilt cylinder;

a load carrying fork supported by the mast so that the fork may be raised and lowered;

a fork height sensor for sensing the fork height;

a load sensor for sensing a load on the fork;

a fluid passage arranged between the tilt cylinder and the tilt valve;

a restricting valve arranged in the fluid passage, wherein the restricting valve controls fluid flow in the fluid passage for regulating tilting of the mast; and a check valve arranged in the fluid passage and between the tilt cylinder and the restricting valve for blocking the fluid flow from the tilt cylinder to the restricting valve at certain times;

wherein the restricting valve regulates tilting of the mast in response to a signal from the fork height sensor or load sensor according to the height of the fork or according to the load on the fork.

* * * * *

UNITED STATES PATENT AND TRADEMARK OFFICE

CERTIFICATE OF CORRECTION

PATENT NO. : 6,125,970
DATED : October 3, 2000
INVENTOR(S) : Takeuchi et al.

It is certified that error appears in the above-identified patent and that said Letters Patent is hereby corrected as shown below:

Title page,
Under FOREIGN PATENT DOCUMENTS,
"WO84/03543" should read -- WO84/003543 --

Column 1,
Line 20, "most" should read -- mast --
Line 56, "typo" should read -- type --

Column 3,
Line 3, "titlt&" should read -- tilts, --
Line 8, "tilt, cylinder" should read -- tilt cylinder --
Line 15, "Tho" should read -- The --
Line 28, "lift lover" should read -- lift lever --

Column 4,
Line 61, "IS" should read -- 15 --

Column 6,
Line 35, "valve teat" should read -- valve seat --
Line 64, "lowered Furthermore" should read -- lowered. Furthermore --

Column 7,
Line 6, "device is each" should read -- device is simple. If each --
Line 60, "rig. 4" should read -- Fig. 4 --

Column 9,
Line 27, "wherein when" should read -- wherein, when --
Line 34, "comprising a, tilt" should read -- comprising a tilt --
Line 41, "sensor wherein" should read -- sensor, wherein --

UNITED STATES PATENT AND TRADEMARK OFFICE

CERTIFICATE OF CORRECTION

PATENT NO. : 6,125,970
DATED : October 3, 2000
INVENTOR(S) : Takeuchi et al.

It is certified that error appears in the above-identified patent and that said Letters Patent is hereby corrected as shown below:

Column 10,
Line 46, "farther" should read -- further --

Signed and Sealed this

Twenty-sixth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,125,970
DATED : October 3, 2000
INVENTOR(S) : Takeuchi et al.

It is certified that error appears in the above-identified patent and that said Letters Patent is hereby corrected as shown below:

Title page,
Item [73], Assignee, "Seisakusha" should read -- Seisakusho --.

Signed and Sealed this

Fifteenth Day of October, 2002

*Attest:*

*Attesting Officer*

JAMES E. ROGAN
*Director of the United States Patent and Trademark Office*